United States Patent [19]

Okubo et al.

[11] Patent Number: 4,638,217

[45] Date of Patent: Jan. 20, 1987

[54] FUSED METAL ION SOURCE WITH SINTERED METAL HEAD

[75] Inventors: Masao Okubo, Kanagawa; Kiyoshi Sugaya, Ibaragi; Toshinori Takagi; Junzo Ishikawa, both of Kyoto, all of Japan

[73] Assignee: Nihon Denshizairyo Kabushiki Kaisha, Amagasaki, Japan

[21] Appl. No.: 476,470

[22] Filed: Mar. 18, 1983

[30] Foreign Application Priority Data

Mar. 20, 1982 [JP] Japan ..... 57-044884

[51] Int. Cl.[4] ..... H01J 7/24; H05B 31/26

[52] U.S. Cl. ..... 315/111.81; 313/163; 313/336; 250/423 R; 250/423 F; 315/111.91

[58] Field of Search ..... 313/336, 362.1, 163; 315/111.81, 111.91; 250/423 R, 423 F

[56] References Cited

U.S. PATENT DOCUMENTS

| | | | |
|---|---|---|---|
| 3,475,636 | 10/1969 | Eckhardt | 313/163 X |
| 3,911,311 | 10/1975 | Heil | 313/362.1 |
| 3,947,716 | 3/1976 | Fraser, Jr. et al. | 313/336 |
| 4,088,919 | 5/1978 | Clampitt et al. | 313/336 |
| 4,318,028 | 3/1982 | Perel et al. | 315/111.81 |
| 4,318,029 | 3/1982 | Jergenson | 315/111.81 |
| 4,325,000 | 4/1982 | Wolfe et al. | 313/336 |
| 4,453,078 | 6/1984 | Shimizu | 315/111.81 |

FOREIGN PATENT DOCUMENTS

| | | | |
|---|---|---|---|
| 2146567 | 3/1973 | France | 315/111.81 |

*Primary Examiner*—Saxfield Chatmon

*Attorney, Agent, or Firm*—Armstrong, Nikaido, Marmelstein & Kubovcik

[57] ABSTRACT

An ion source having a sintered metal head for ionizing various substances is disclosed. This ion source comprises a container made of a material which has a higher fusing point than that of the substance which is to be ionized, and a tip formed of a molded sintered metal of a higher fusing point than that of the substance which is to be ionized. The head is formed into a nearly conical shape and has a porosity capable of allowing the substance which is to be ionized to infiltrate therethrough in the molten state and the tip of the head is positioned at the opening of one end of the container for the ionizable material and arranged in such a manner that it protrudes beyond the end of the container.

6 Claims, 4 Drawing Figures

Fig. 2(a)
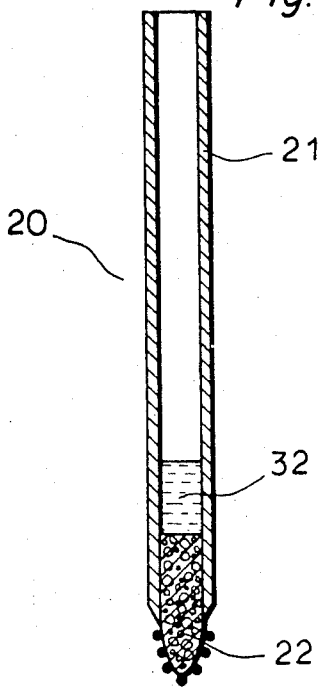
Fig. 2(b)
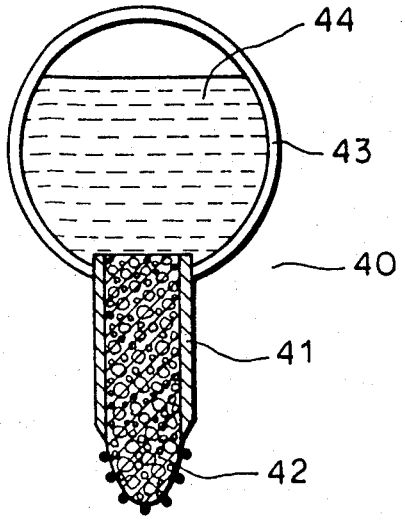
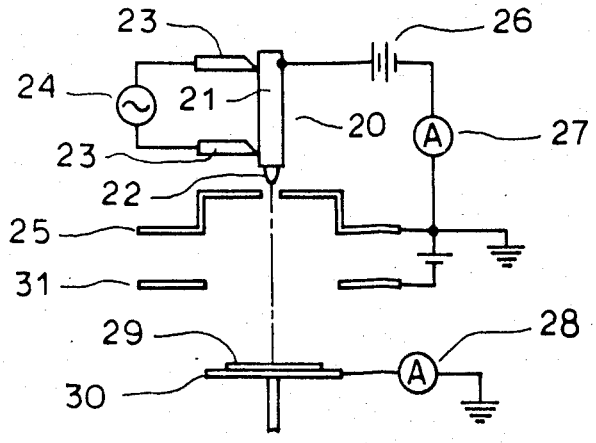
Fig. 3

FUSED METAL ION SOURCE WITH SINTERED METAL HEAD

BACKGROUND OF THE INVENTION

1. Field of the Invention

This invention relates to an ion source which makes ions generate in various kinds of substances, and more particularly, relates to a fused metal ion source of the field emission type.

2. Description of the Prior Art

In recent years, the field of technique which makes use of ions of various substances is of very wide range convering, for example, nuclear fusion (heating by plasma, treatment of reactor walls), high energy physics (accelerator), heavy ion science, ion rocket, ion implantation (doping of impurity, surface control of physical properties), film formation (surface coating, developement of film-shaped devices), or others.

With a view to obtaining ions of various substances, a variety of methods are being proposed and put into practice.

By way of example, there is a method of extracting ions by impressing high voltage on substances which are to be ionized, wherein a fused metal ion source of the field emission type is employed as a species of metal ion sources generating ions in various kinds of substances.

FIG. 1 in the accompanying drawings is illustrations showing in brief the cross-sections of examples of conventional fused metal ion sources of the field emission type.

FIG. 1 (*a*) and (*b*) each are generally called a needle-type, and FIG. 1 (*c*) is called a capillary-type, as described in, for example, "Studies of field emission gallium ion sources" by A. J. Dixon and A. von Engel, Inst. Phys. Conf. Ser. No. 54 (1980), page 292.

In FIG. 1 (*a*), the field emission fused metal ion source of the needle-type has a needle, which is made of a material having a high fusing point and the head of which is several to several ten microns in diameter, concentrically built in a nearly cylinder shaped pipe which is made of a different kind of metal also having a high fusing point.

When the needle is heated up, a substance which is to be ionized fuses and infiltrates into the gap between the pipe and the needle to moisten the head of the needle.

Another field emission fused metal ion source of the needle-type shown in FIG. 1 (*b*) is also made of a material having a high fusing point, but in the form of omitting the nearly cylinder-shaped pipe shown in FIG. 1 (*a*). The needle, the head of which is several microns, is welded to a heating filament. To the needle clings a substance which is to be ionized. When the needle is heated up, the substance which is to be ionized begins to fuse and comes to moisten the head of the needle.

As for the field emission fused metal ion source of the capillary-type shown in FIG. 1 (*c*), it also is made of a material of a high fusing point. It constitutes a cone-shaped body being provided with a small diameter throughhole in the longitudinal direction. When this cone-shaped body is heated up, the substance to be ionized fuses, begins to infiltrate into through-hole, and makes the cone-shaped body moist.

When a high voltage is impressed on the metal ion source in such a moist state as mentioned above, then a heavy electric field is present at the head of the ion source, whereby the subtance to be ionized is emitted from the liquid surface, and ionized just before the head of the metal ion source, thus being able to be extracted, at which time the form of the ion emitting face, it is believed, is determined in the ionizing zone. That is, a minute zone of plasma (called a plasma ball) is created just before the head of the metal ion source.

The plasma ball changes according to the working conditions of the field emission fused metal ion source, for example, conditions such as the magnitude of ion current, in proportion to which the beam characteristics such as the angular aperture and the like vary by a large margin.

For all that, there is no way to obtain any control of supplying the substance which is to be ionized to the head zone of conventional field emission fused metal ion sources, so that it is impossible to control an optimum quantity of working flow, and it is difficult to stably operate on the conventional apparatus because of a large quantity of vapor of neutral particles being emitted at the time of ionizing the subtances of high vapor pressure at a temperature near to a fusing point.

Particularly, in the metal ion source of the type shown in FIG. 1 (*b*), it is hard to operate continuously for long hours on account of the total amount of the substance to be ionized which clings to the needle wet being infinitesimal.

On the other hand, it is desired that the emission of ions from the metal ion source should endure for long hours, while it is required that the angular aperture of ion beam should be stable and small in the case where it is intended to elaborate and control any minute object by the use of ion beam.

However, all conventional field emission fused metal ion sources can not satisfy such requirements as mentioned above.

SUMMARY OF THE INVENTION

It is therefore an object of this invention to make the emission of ions from the metal ion source endure for long hours, to control the amount of substance to be ionized, and to stabilize the plasma ball zone.

Another object of this invention to provide a field emission fused metal ion source having the ability to stably minimize the angular apertrue of ion beam.

For these ends, this invention comprises a pipe being made of a material of a higher fusing point that at least that of a substance which is to be ionized, and a tip including a metal of a higher fusing point than at least that of the substance which is to be ionized, forming itself at its head part into a nearly conical shape, and having the porosity capable of allowing the fused substance which is to be ionized to infiltrate therethrough. The tip is characterized by being provided at the opening part of one end of the pipe in such a manner that its head part shall protrude from the end of the pipe.

BRIEF DESCRIPTION OF THE DRAWINGS

FIG. 2 (*a*) and (*b*) are illustrations showing roughly in cross-section two different examples of this invention;

FIG. 3 is a diagram of the principle underlying a metal ion generator which has the ion source according to this invention;

FIG. 4 (*b*) and (*c*) are explanatory graphs representing the variations of the angular aperture of ion beam, the one (*b*) is by the author of this invention, and the other (*c*) is by other persons.

DESCRIPTION OF THE PREFERRED EMBODIMENTS

Figure 1A:
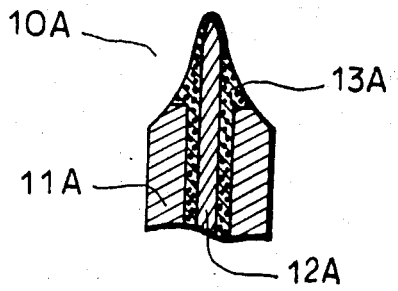
Fig. 1(a) PRIOR ART
FIG. 1 is illustrations showing roughly in cross-section a few examples of conventional field emission fused metal ion sources, out of which FIG. 1 (*a*) and (*b*) each are called a needle-type, and FIG. 1 (*c*) is called a capillary-type.
Figure 1B:
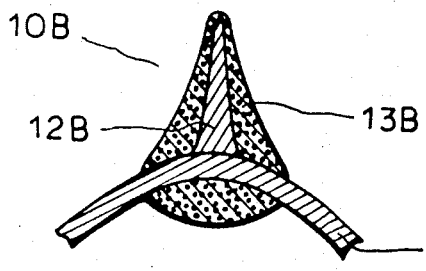
Fig. 1(b) PRIOR ART
Figure 1C:
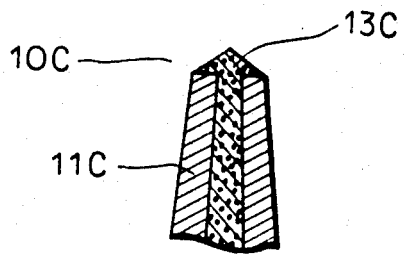
Fig. 1(c) PRIOR ART

In FIG. 2 (*a*), reference number 21 indicates a pipe, which in made of a material (in this example, for instance, tungsten) having a higher fusing point than at least that of a substance to be ionized, and which opens at both ends. Reference numeral 22 indicates a tip which comprises a metal having a higher fusing point than at least that of a substance to be ionized, is shorter than the pipe 21, and is formed at its head part into a nearly conical shape. This tip is molded, for example, by sintering a pulverulent body of a metal having a higher fusing point than that of a suitable ionizing medium, so that it has the porosity capable of allowing the fused substance to be ionized so as to infiltrate therethrough.

For the said pulverulent body there are used, for example, metals such as tungsten, molybdenum, nickel, and the like, but it is preferable at any rate to select out of such metals the ones that are better in wettability by the fused substances to be ionized.

The particle size of the above pulverulent body of metal lies usually in the range of from several microns to several hundred microns seeing that the electric field is apt to be present at the head part of the tip, but it is preferable that the particle size is determined in relation to the substance to be ionized. On the other hand, it does not matter of course if the above pulverulent body would be mixed with another pulverulent body having a different particle size with a view to controlling the flow of the substance to be ionized.

To give an instance, when gallium is to be ionized, the tip 22 in the present example is formed by mixing tungsten powder of 100 microns in diameter and tungsten powder of 10 microns in diameter, each in almost like quantity. This tip 22 is provided at the opening part of one end of the pipe 21 in such a manner that its head part may protrude therefrom, while a substance 32 to be ionized is put in the pipe 21.

On the other hand, FIG. 2 (*b*) is an illustration showing roughly the cross-section of another example of the present invention, wherein the field emission fused metal ion source 40 is constracted by fitting the porous tip 42 mentioned above fixedly in the pipe 41 which is inserted into a metallic container 43 including a substance 44 to be ionized within.

By the way it does not matter of course if the above pipe 41 and container 43 are formed integrally in one body.

Description will be now directed to an example of how to use the field emission fused metal ion source mentioned above:

FIG. 3 is a diagram of the principle underlying a metal ion generator which employs the present invention. In the figure, reference numeral 20 indicates the field emission fused metal ion source as the present invention. To both ends of the pipe 21 of the field emission fused metal ion source 20 is connected a power source of the heater 24 through the interposition of contactors 23, being made of, for example, molybdenum. Reference numeral 25 indicates pickup electrodes which are grounded.

Between these pickup electrodes and the top end part of the pipe 21 is connected a pickup source of voltage 26.

The reference numerals 27 and 28 shown in the figure indicate the respecive ammeters, the former 27 is for measuring the circuit current and the latter 28 is for measuring the ion current. Reference numeral 29 indicates, for example, a baseplate which is mounted on a baseplate-holder 30 and to which ions are irradiated. Between the baseplate 29 and the abovementioned pickup electrodes 25 are placed Faraday electrodes 31 for checking secondary electrons coming from the baseplate.

When the substance to be ionized is poured through the open part of the upper end of the pipe 21 and the pipe 21 is heated by driving the power source of the heater 24, then the substance being poured into the pipe 21 is fused and begins to infiltrate into the tip 22 which is attached to the lower end of the pipe 21, as a result of which the surface of the tip 22 is made moist with the fused substance to be ionized. At this time, the flow of the substance to be ionized is controlled by the size and temperature of the constituent particles of the porous tip.

When high voltage is applied between both the pickup electrode 25 provided adjacent to the tip 22 and the upper end of the pipe 21 by the use of the pickup voltage source 26, then the ions are picked up from the fused substance which clings to the surface of the particles of 100 microns in diameter projecting over the surface of the tip 22, which ions are accelerated and implanted into, for example, the baseplate 29.

At this time, there is formed the plasma ball which determines the geometry of ion emission along the contour of the head part of the porous tip. As a result, in the present invention, the change in the form of the plasma ball is rare as against the change of the working condition of the ion source, and the properties of ion beam also are kept stable.

Figure 4A:
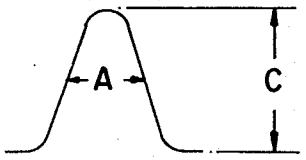
FIG. 4 (*a*) is a diagram relating to a way of measurement of the angular aperture of the ion beam.
Figure 4C:
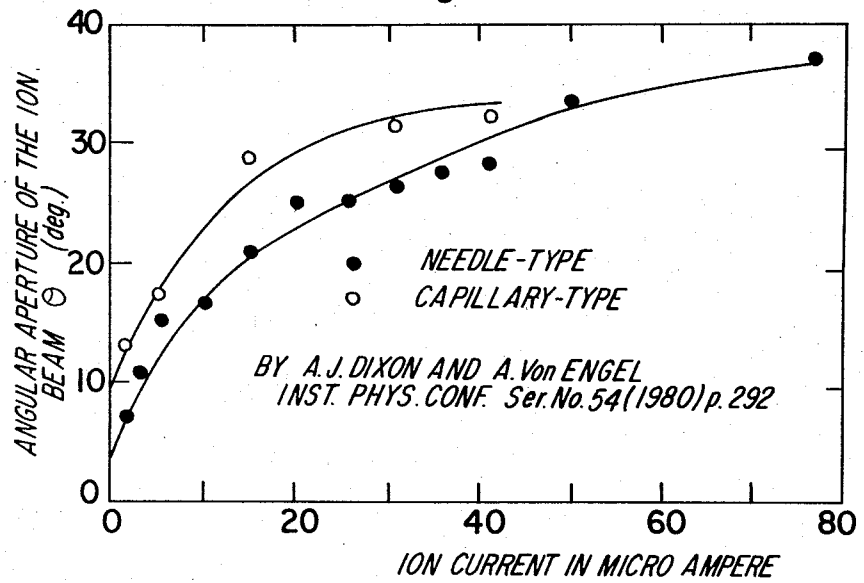
Figure 4B:
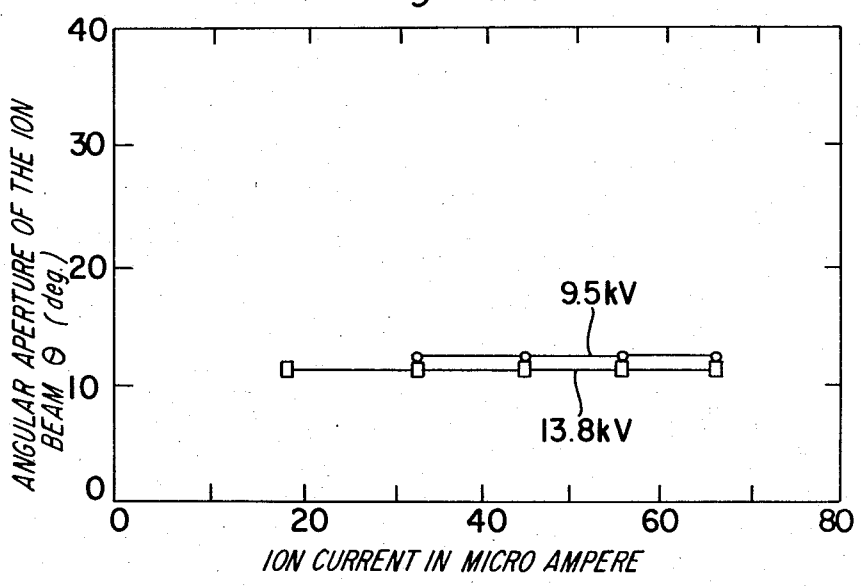

FIG. 4 shows a few explanatory graphs expressing the change of the angular aperture of the ion beam in contrast to the change of the ion current, wherein FIG. 4 (*a*) shows an ion beam profile on the position at a prescribed distance away from the metal ion source, which is measure, in the present example, by the use of what is called Faraday cup. In FIG. 4 (*a*), symbol A represents the expanding breadth of ion beam showing one half value of the maximum value of the strength of ion beam. Supposing the distance between the head of the porous tip and the Fraday cup is D, then the angular aperture (half angle) of ion beam $\theta$ may be expressed by the following formula:

$$\theta = \tan^{-1}(\tfrac{1}{2})\cdot(A/D)$$

On the other hand, FIG. 4(*b*) gives the correlation between the ion current and the angular aperture of the ion beam in the ion source of the present invention, while FIG. 4(*c*) shows that of a conventional ion source.

By the way, the ion current here has been measured by the ammeter 28 shown in FIG. 3. In FIG. 4(*b*), the mark of O denotes the value at the time of the pickup voltage remaining at 9.5 KV, while the mark of □ denotes the value at the time of the pickup voltage being at 13.8 KV.

As apparent from from the above description, the angular aperture of the ion beam at the time of using the ion source of the present invention has less change attributable to the magnitude of the ion current, and is stabler and smaller, as commpared with the angular aperture at the time of using a conventional.

Further, this invention is able to hold a relatively great deal of a substance to be ionized either by making the pipe 21 longer or by being combined with a receptacle of fused metal, and can control the quantity of flow by selecting properly the size of the constituent particles of the porous tip so that it is possible for this invention to endure the ion emission for long hours.

As clearly understood from the above description of an example of this invention, the field emission fused metal ion source according to the invention has the ability not only to endure the ion emission for long hours but also to stably minimize the angular aperture of ion beam, thereby providing good results in practical use.

What is claimed is:

1. A field emission ion source comprising:

a container for a fusible material to be ionized, said container being formed of a material having a higher fusing point than said fusible material and having an opening therein; and an ioning tip fixed in and protruding from said opening, said tip comprising a body formed of pulverulent metal having a degree of porosity to allow said fusible material to infiltrate therethrough in the molten state, wherein said porosity is determined by mixing pulverulent metal particles of different size.

2. A field emission ion source as recited in claim 1, wherein said ionizing tip comprises a mixture of pulverulent metal powders having diameters of approximately 10 microns and 100 microns.

3. A field emission ion source as recited in claim 2, wherein said ionizing tip comprises approximately equal weights of tungsten powders having diameters of 10 microns and 100 microns.

4. A field emission fused metal ion source comprising:

a container for a fusible metal to be ionized, said container being formed of a material having a higher fusing point than said fusible metal;

a pipe forming part of said container and including a body of molded sintered material fixed therein, said sintered material being wettable by said fusible metal in the molten state and comprising a mixture of sintered particles having a degree of porosity to said molten fusible metal to allow its infiltration therethrough said porosity being determined by mixing sintered material particles of different size;

said body being formed with an end of substantially conical shape forming an ionizing tip and being fixed in said pipe with said conical end protruding from an end of said pipe; and heating means for melting said fusible metal whereby said molten fusible metal will wet said body of sintered material and infiltrate therethrough to said ionizing tip.

5. A field emission fused metal ion source as recited in claim 4 wherein said mixture of sintered particles consists of particles having diameters of approximately 10 microns and 100 microns.

6. A field emission fused metal ion source as recited in claim 5 wherein said mixture of sintered particles comprises approximately equal weights of tungsten powders having diameters of approximately 10 microns and 100 microns.

* * * * *

UNITED STATES PATENT AND TRADEMARK OFFICE

CERTIFICATE OF CORRECTION

PATENT NO. : 4,638,217

DATED : January 20, 1987

INVENTOR(S) : Masao OKUBO et al

It is certified that error appears in the above-identified patent and that said Letters Patent is hereby corrected as shown below: On the title page assignee should read -- [73] Assignee: NIHON DENSHIZAIRYO KABUSHIKI KAISHA, Amagasaki, Japan, of the interests of Masao Okubo and Kiyoshi Sugaya --, Signed and Sealed this Sixteenth Day of February, 1988

*Attest:*

DONALD J. QUIGG

*Attesting Officer*

*Commissioner of Patents and Trademarks*